US008997845B2

(12) United States Patent
Ulics, Jr. et al.

(10) Patent No.: US 8,997,845 B2
(45) Date of Patent: Apr. 7, 2015

(54) HEAT EXCHANGER WITH LONG AND SHORT FINS

(75) Inventors: George Ulics, Jr., Carleton, MI (US); Thomas B. Harris, Taylor, MI (US); Thomas J. Joseph, Sr., Commerce Township, MI (US); John A. Thomas, Ann Arbor, MI (US)

(73) Assignee: Automotive Components Holdings, LLC, Dearborn, MI (US)

( * ) Notice: Subject to any disclaimer, the term of this patent is extended or adjusted under 35 U.S.C. 154(b) by 1357 days.

(21) Appl. No.: 12/405,324

(22) Filed: Mar. 17, 2009

(65) Prior Publication Data

US 2010/0236766 A1 Sep. 23, 2010

(51) Int. Cl.

| | |
|---|---|
| ***F28F 1/16*** | (2006.01) |
| ***F28D 1/053*** | (2006.01) |
| *F28D 21/00* | (2006.01) |
| *F28F 9/18* | (2006.01) |

(52) U.S. Cl.

CPC .... *F28D 1/05383* (2013.01); *F28D 2021/0096* (2013.01); *F28F 1/16* (2013.01); *F28F 9/182* (2013.01)

(58) Field of Classification Search

CPC ..... F28F 1/16; F28F 1/18

USPC ..... 165/148, 153, 177, 173, 175, 178, 181, 165/183

See application file for complete search history.

(56) References Cited

U.S. PATENT DOCUMENTS

| | | | | |
|---|---|---|---|---|
| 1,821,080 | A * | 9/1931 | Sprong | 165/183 |
| 1,821,434 | A * | 9/1931 | Hamilton | 165/177 |
| 3,495,657 | A * | 2/1970 | Keith | 165/183 |
| 4,657,074 | A * | 4/1987 | Tomita et al. | 165/179 |
| 4,794,985 | A * | 1/1989 | Paulman et al. | 165/150 |
| 4,926,933 | A | 5/1990 | Gray | |
| 5,036,913 | A * | 8/1991 | Murphy et al. | 165/173 |
| 7,011,149 | B2 * | 3/2006 | Fujita et al. | 165/173 |
| 7,028,766 | B2 | 4/2006 | Ren | |
| 7,044,211 | B2 | 5/2006 | Insalaco | |
| 7,073,570 | B2 * | 7/2006 | Yu et al. | 165/140 |
| 2004/0177948 | A1 | 9/2004 | Cho et al. | |

* cited by examiner

*Primary Examiner* — Allen Flanigan

(74) *Attorney, Agent, or Firm* — MacMillan, Sobanski & Todd, LLC

(57) ABSTRACT

A heat exchanger includes two headers and tubes secured to and extending between the headers, each tube including a wall formed with a leading surface, a trailing surface and lateral surfaces extending between the headers and interconnecting the leading and trailing surfaces, a passage enclosed by the wall for carrying fluid between the headers, and long and short fins formed integrally with and extending outward from the wall.

15 Claims, 3 Drawing Sheets

HEAT EXCHANGER WITH LONG AND SHORT FINS

BACKGROUND OF THE INVENTION

1. Field of the Invention

This invention relates generally to a heat exchanger for transferring heat to an air stream from a heat source flowing in tubes, and, in particular, to a heater core in the passenger compartment of an automotive vehicle.

2. Description of the Prior Art

Conventionally, the tubes, which carry engine coolant through the heater core of an automotive vehicle, are arranged parallel to the stream of air that passes through the heater core. The heater core usually includes one or two rows of tubes, the second row being in-line and parallel to the first row.

It has long been understood that the heat transfer rate is much larger for turbulent flow than for laminar flow. Increasing turbulence of the air stream through the heater core is beneficial to the convection heat transfer rate and improves the overall performance of the heat exchanger. It is also more effective to increase the heat transfer on the air-side to improve the heat exchanger, as this is the more restrictive side compared to the rate of heat transferred from the fluid flowing inside the tube.

Generally, fins located between the tubes are secured to the outer surface of the tubes to enhance heat transfer from the coolant to the air stream. In order to induce turbulence in the air stream, fins on the outer surface of the tubes are usually mutually staggered and offset, but the tubes are aligned parallel to the air stream.

A need exists in the industry for techniques that improve heat transfer in a heater core without increasing its package size.

SUMMARY OF THE INVENTION

A heat exchanger includes two headers and tubes secured to and extending between the headers, each tube including a wall formed with a leading surface, a trailing surface and lateral surfaces extending between the headers and interconnecting the leading and trailing surfaces, a passage enclosed by the wall for carrying fluid between the headers, and long and short fins formed integrally with and extending outward from the wall.

The heat exchanger increases the heat transfer surface area and reduces the complexity and number of components compared to a conventional heat exchanger having the same package space requirements.

The heat exchanger increases turbulence of the air flow through the exchanger by changing the heater core tube geometry in contact with the air flow, thereby increasing the convection heat transfer rate and improving the overall performance of the heat exchanger.

The integral extruded tube-fin process improves the structural integrity of the relationship between the tube and fins, and minimizes the number and complexity of the manufacturing process steps.

The scope of applicability of the preferred embodiment will become apparent from the following detailed description, claims and drawings. It should be understood, that the description and specific examples, although indicating preferred embodiments of the invention, are given by way of illustration only. Various changes and modifications to the described embodiments and examples will become apparent to those skilled in the art.

DESCRIPTION OF THE DRAWINGS

The invention will be more readily understood by reference to the following description, taken with the accompanying drawings, in which.

DESCRIPTION OF THE PREFERRED EMBODIMENT

Figure 1:
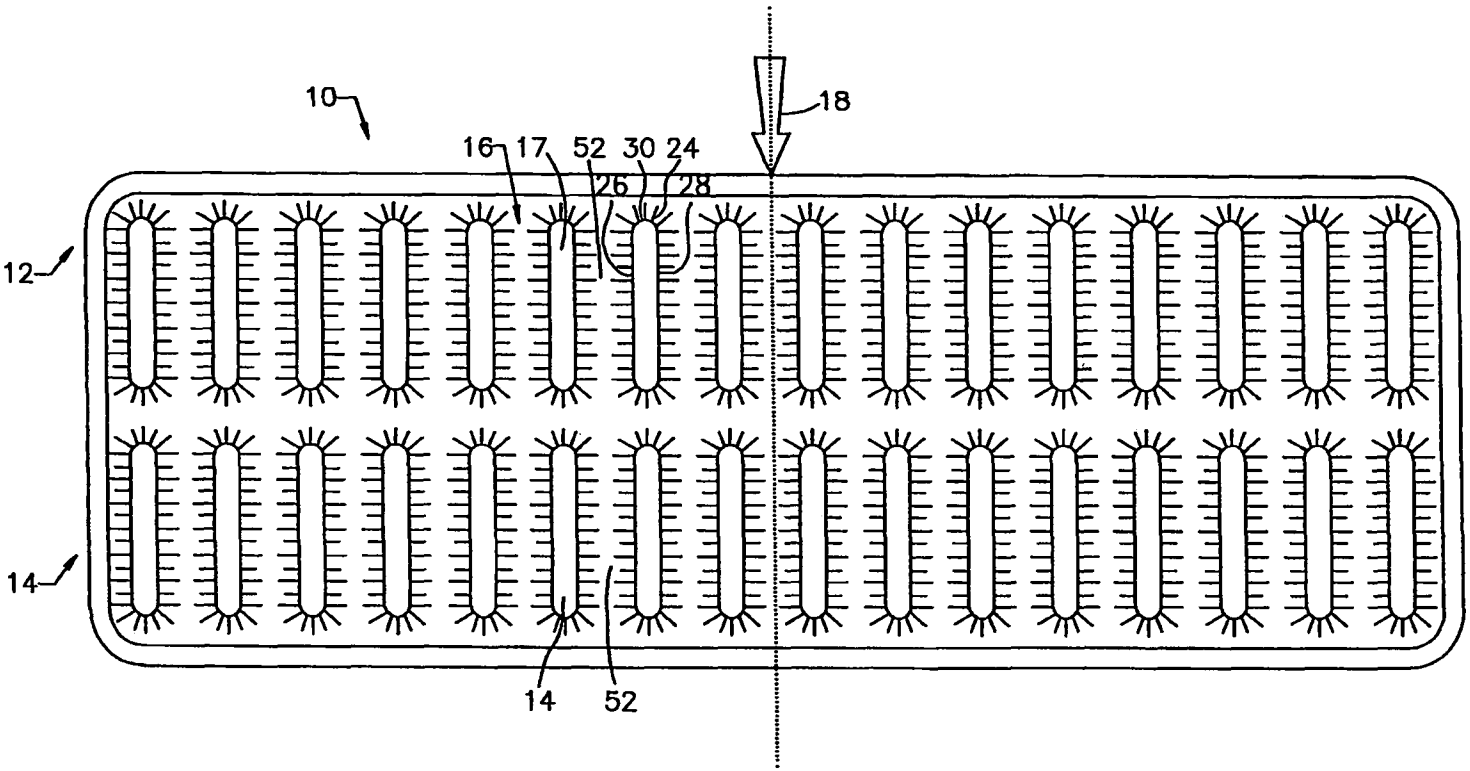
FIG. 1 is a top view showing two rows of tubes assembled in a header plate.

Referring now to the drawings, there is illustrated in FIG. 1 a header plate 10 for a heater core having a first row 12 and a second row 14 of flat, thin-walled tubes 16 arranged parallel to an air stream 18 as it enters the first row.

Each tube 16 includes a passage 17 that carries hydraulic engine coolant along the tube length between tanks 20, 22 located at opposite ends of the tubes. Each tube 16 has a height, which extends between flat lateral surfaces 26, 28 of the tube wall 24; a depth, which extends laterally between the leading surface 30 and trailing surface 32; and a length, which extends along the tube, perpendicular to the plane of the page and between the tanks 20, 22.

Each tube of the second row 12 is aligned with a tube of the first row. The lateral outer surfaces 26, 28 of each tube of the first row 10 are arranged parallel to the corresponding lateral outer surfaces of a tube of the second row 12 and substantially parallel to the air stream 18 entering the first row.

Figure 2:
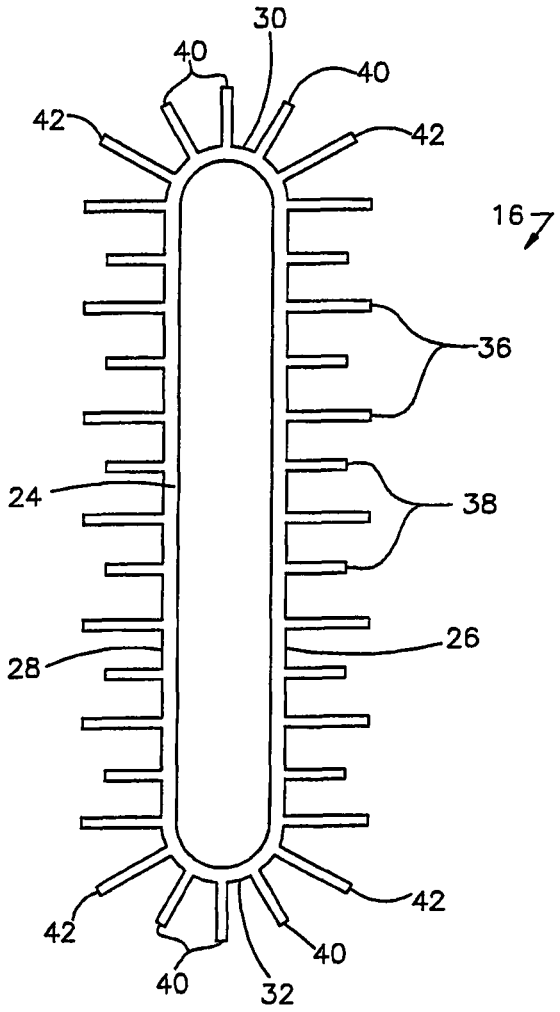
FIG. 2 is top view of a tube showing the arrangement of short and long fins.

FIG. 2 shows that each tube is formed with long fins 36 and short fins 38 extending outward and substantially perpendicular to the lateral surfaces 26, 28 of the tube wall 24 and the arcuate leading surface 30 and trailing surface 32. A long fin 36 is located between consecutive short fins 38 along the lateral surfaces 26, 28 of the tube wall 24. Preferably three short fins 40 and two long fins 42 extend outward from the arcuate leading and trailing surfaces 30, 32. The long and short fins 36, 38 of consecutive tubes 16 are mutually aligned creating a flow path in which air flow between consecutive tubes is turbulent.

Preferably the tubes 16 and fins 36, 38, 40, 42 are extruded such that the fins are formed integrally with the walls 24 without a separating space or a joint required to connect the fins to the outer surfaces of the walls.

Figure 3:
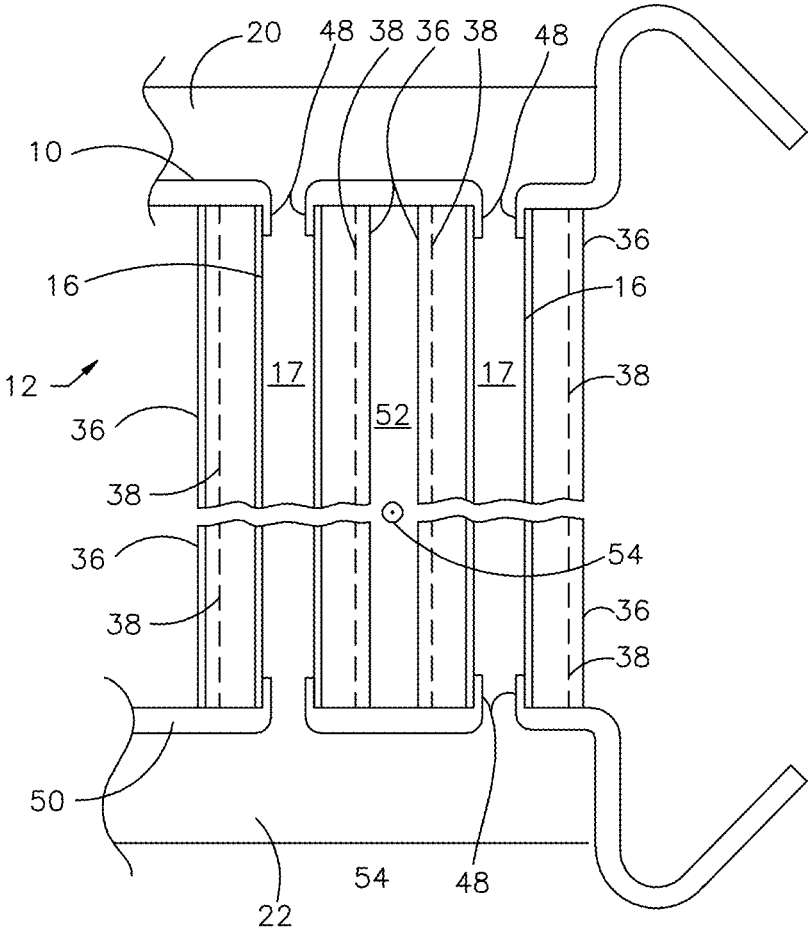
FIG. 3 is a side view of a heater core showing the tubes assembled in headers with tanks installed.

FIG. 3 shows a tube 16 extending between tanks 20, 22 and secured, preferably by brazing, to collars 48 formed on header plates 10, 50 and enclosing the end of the tube 16. The brazed connection seals the headers 10, 50 and tubes against leakage of the engine coolant carried in the tubes. The space 52 between the short and long fins 36, 38 of consecutive tubes 16 provide a space in which the air stream passes in direction 54 over the tubes and fins carrying convected heat from the engine coolant in the tubes to the air stream.

In accordance with the provisions of the patent statutes, the preferred embodiment has been described. However, it should be noted that the alternate embodiments can be practiced otherwise than as specifically illustrated and described.

The invention claimed is:

1. A heat exchanger for an automotive vehicle comprising:

two headers; and tubes secured to and extending between the headers, each tube including a wall formed with a leading surface, a trailing surface and lateral surfaces interconnecting the leading surface and trailing surface, a passage enclosed by the wall for carrying fluid between the headers, a space between adjacent tubes for carrying an air stream flowing through the heat exchanger from the leading surface toward the trailing surface, and long and short planar fins, each fin secured to the wall, extending outward from the wall and parallel to a length of said tube, the plane of each long and short fin being normal to the wall, and extending between the headers, the long fins and short fins alternating along a depth of the wall;

wherein the tubes are arranged in first and second parallel rows, each tube of the first row including a length that extends parallel to a tube of the second row between the headers, the lateral surfaces of the tubes of the first row being parallel to the lateral surfaces of the tubes of the second row.

2. The heat exchanger of claim 1 wherein:

the leading surfaces are convex, arcuate, and formed with the fins extending outward from each tube and facing the air steam; and the trailing surfaces are convex, arcuate, and formed with the fins extending outward from each tube and away from the air stream.

3. The heat exchanger of claim 1 wherein:

each long fin is directed substantially perpendicular to each lateral surface, and each short fin is substantially perpendicular to each lateral surface and is located between two of the long fins.

4. The heat exchanger of claim 1 wherein each tube includes long fins directed substantially perpendicular to a respective lateral surface and short fins substantially perpendicular to each lateral surface, each short fin located between two of the long fins, the long fins of a tube of the first row being aligned with the long fins of an adjacent tube of the first row, the long fins of a tube of the second row being aligned with the long fins of an adjacent tube of the second row.

5. The heat exchanger of claim 1 wherein:

a first of the headers includes a first header plate having a hole and a first collar extending into a first portion of a length of one of the tubes;

a second of the headers includes a second header plate having a hole and a second collar extending into a second portion of a length of said tube; and a brazed connection joining the collars to the tube.

6. A heat exchanger for an automotive vehicle comprising:

first and second mutually spaced headers;

a first row of tubes extending between and secured to the headers, each tube including a wall formed with a leading surface, a trailing surface and lateral surfaces interconnecting the leading surface and trailing surface, a space between adjacent tubes of the first row for carrying an air stream flowing through the heat exchanger from the leading surface toward the trailing surface, a passage enclosed by the wall for carrying fluid between the headers; and a second row of tubes extending between and secured to the headers, each tube including a wall formed with a leading surface, a trailing surface and lateral surfaces interconnecting the leading surface and trailing surface, a second space between adjacent tubes of the second row for carrying an air stream flowing through the heat exchanger from the leading surface toward the trailing surface, a passage enclosed by the wall for carrying fluid between the headers;

each tube secured to and extending between the headers, each tube including a wall formed with a leading surface, a trailing surface and lateral surfaces interconnecting the leading surface and trailing surface, a passage enclosed by the wall for carrying fluid between the headers, and long and short planar fins, each fin secured to the wall, extending outward from the wall and parallel to a length of said tube, the plane of each long and short fin being normal to the wall, and extending between the headers, the long fins and short fins alternating along a depth of the wall.

7. The heat exchanger of claim 6 wherein:

the leading surfaces are convex, arcuate, and formed with the fins extending outward from each tube and facing the air steam; and the trailing surfaces are convex, arcuate, and formed with the fins extending outward from each tube and away from the air stream.

8. The heat exchanger of claim 6 wherein:

each long fin is directed substantially perpendicular to each lateral surface, and each short fin is substantially perpendicular to each lateral surface and is located between two of the long fins.

9. The heat exchanger of claim 6 wherein:

the tubes are arranged in first and second parallel rows, each tube of the first row includes a length that extends parallel to a tube of the second row between the headers, the lateral surfaces of the tubes of the first row is parallel to the lateral surfaces of the tubes of the second row.

10. The heat exchanger of claim 6 wherein:

the tubes are arranged in first and second parallel rows;

each tube of the first row including a length that extends parallel to a tube of the second row, the lateral surfaces of the tubes of the first row being parallel to the lateral surfaces of the tubes of the second row; and each tube includes long fins directed substantially perpendicular to a respective lateral surface and short fins substantially perpendicular to each lateral surface, each short fin located between two of the long fins, the long fins of a tube of the first row being aligned with the long fins of one of the tubes of the first row, the long fins of a tube of the second row being aligned with the long fins of one of the tubes of the second row.

11. The heat exchanger of claim 6 wherein:

the first header includes a first header plate having holes and collars, each collar aligned with one of the holes and extending into a first portion of a length of one of the tubes of the first and second rows;

the second header includes a second header plate having holes and second collars, each second collar extending into a second portion of a length of one of the tubes of the first and second rows; and brazed connections, each connection joining one of the collars to one of the tubes.

12. A heat exchanger for an automotive vehicle comprising:

a first header including a plate formed with holes and first collars, each first collar aligned with one of the holes;

a second header including a second plate spaced from the first plate, having second holes and second collars, each second collar aligned with one of the second holes;

tubes secured to and extending between the headers, each tube including a wall formed with a leading surface, a trailing surface and lateral surfaces interconnecting the leading surface and trailing surface, a passage enclosed by the wall for carrying fluid between the headers, a space between adjacent tubes for carrying an air stream flowing through the heat exchanger from the leading surface toward the trailing surface, and long and short planar fins, each fin secured to the wall, extending outward from the wall and parallel to a length of said tube, the plane of each long and short fin being normal to the wall, and extending between the headers, the long fins and short fins alternating along a depth of the wall; and brazed connections, each connection joining one of the first collars to one of the tubes and one of the second collars to said tube;

wherein the tubes are arranged in first and second parallel rows, each tube of the first row including a length that extends parallel to a tube of the second row between the headers, the lateral surfaces of the tubes of the first row being parallel to the lateral surfaces of the tubes of the second row.

13. The heat exchanger of claim 12 wherein the tubes further comprise:

leading surfaces formed with the fins extending outward from each tube and facing the air steam; and trailing surfaces formed with the fins extending outward from each tube and away from the air stream.

14. The heat exchanger of claim 12 wherein:

each long fin is directed substantially perpendicular to each lateral surface , and each short fin is substantially perpendicular to each lateral surface and is located between two of the long fins.

15. The heat exchanger of claim 12 wherein each long fin is directed substantially perpendicular to a respective lateral surface, and each short fin is substantially perpendicular to each lateral surface, each short fin is located between two of the long fins, the long fins of a tube of the first row being aligned with the corresponding long fins of a consecutive tube of the first row, the long fins of a tube of the second row being aligned with the corresponding long fins of a consecutive tube of the second row.

* * * * *